US009096072B1

(12) United States Patent
Saga

(10) Patent No.: US 9,096,072 B1
(45) Date of Patent: Aug. 4, 2015

(54) THERMAL PRINTER AND METHOD FOR CHECKING DISCONNECTION

(71) Applicant: TOSHIBA TEC KABUSHIKI KAISHA, Shinagawa-ku, Tokyo (JP)

(72) Inventor: Kengo Saga, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 18 days.

(21) Appl. No.: 14/153,192

(22) Filed: Jan. 13, 2014

(51) Int. Cl.

| | |
|---|---|
| ***B41J 2/35*** | (2006.01) |
| ***B41J 2/355*** | (2006.01) |
| *B41J 2/21* | (2006.01) |
| *B41J 2/165* | (2006.01) |

(52) U.S. Cl.
CPC ..... *B41J 2/355* (2013.01); *B41J 2/16579* (2013.01); *B41J 2/2142* (2013.01); *B41J 2/35* (2013.01)

(58) Field of Classification Search
USPC ..... 347/19, 211, 171
See application file for complete search history.

(56) References Cited

U.S. PATENT DOCUMENTS

| | | | | |
|---|---|---|---|---|
| 4,500,893 | A * | 2/1985 | Sakura et al. | 347/211 |
| 4,769,657 | A * | 9/1988 | Takahashi | 347/171 |
| 5,951,175 | A * | 9/1999 | Kawamori | 400/120.01 |
| 6,738,085 | B2 | 5/2004 | Hachinoda | |
| 8,102,409 | B2 | 1/2012 | Koyama et al. | |

FOREIGN PATENT DOCUMENTS

| | | | | |
|---|---|---|---|---|
| JP | 08-251484 | * | 9/1996 | H04N 5/335 |
| JP | 2006-62085 | * | 3/2006 | B41J 2/35 |
| JP | 2007-180616 | * | 7/2007 | H04N 5/335 |
| JP | 2008-288723 | * | 11/2008 | H04N 5/335 |

OTHER PUBLICATIONS

Computer-generated translation of JP 2008-288723, published on Nov. 2008.*
Computer-generated translation of JP 2007-180616, published on Jul. 2007.*
Computer-generated translation of JP 2006-62085, published on Mar. 2006.*

* cited by examiner

*Primary Examiner* — Huan Tran
(74) *Attorney, Agent, or Firm* — Amin, Turocy & Watson, LLP

(57) ABSTRACT

Generally, in accordance with embodiments, a thermal printer comprises heating elements, a storage section, a drive circuit and a controller. A plurality of heating elements are linearly arranged. The storage section stores a one-line amount of image data. The drive circuit energizes each heating element according to the one-line amount of image data. An acquisition section acquires an A/D value corresponding to the voltage applied to each heating element every time each heating element is energized. The controller outputs a one-line amount of empty data to the storage section to acquire a first A/D value with the acquisition section, reduces, based on the first A/D value, noises of a second A/D value which is acquired by energizing each heating element and checks the disconnection of each heating element based on the noise-reduced second A/D value.

6 Claims, 5 Drawing Sheets

THERMAL PRINTER AND METHOD FOR CHECKING DISCONNECTION

FIELD

Embodiments described herein relate to a technology for detecting the broken line of a thermal head.

BACKGROUND

A thermal head comprises a plurality of heating elements linearly arranged. A thermal printer enables heating elements of a thermal head to emit heat selectively to make a thermosensitive sheet sense heat or melts the ink of an ink ribbon and transfers the ink to carry out printing.

The heating elements are easily disconnected by the physical impact or thermal abrasion during a printing process. The disconnection of the heating elements causes a bad influence on the printing quality of a thermal printer. Thus, a thermal printer frequently detects the disconnection of the thermal head and confirms the state of the thermal head.

When checking a disconnection, a thermal printer supplies the power to each heating element sequentially and acquires the A/D value of the voltage applied to each heating element. The thermal printer determines whether or not each heating element is in a disconnection state based on the A/D value.

However, the noises contained in the A/D value lead to a reduction in the accuracy in determination on a disconnection state.

DETAILED DESCRIPTION

Generally, in accordance with embodiments, a thermal printer comprises heating elements, a storage section, a drive circuit and a controller. A plurality of heating elements are linearly arranged. The storage section stores a one-line amount of image data. The drive circuit supplies the power to each heating element according to the one-line amount of image data. An acquisition section acquires an A/D value corresponding to the voltage applied to each heating element every time a heating element is energized. The controller 1 outputs a one-line amount of empty data to the storage section to acquire a first A/D value with the acquisition section, reduces, based on the first A/D value, noises of a second A/D value which is acquired by energizing each heating element and checks the disconnection of each heating element based on the noise-reduced second A/D value.

Generally, according to embodiments, a disconnection check method is a disconnection check method for a thermal printer comprising a plurality of linearly arranged heating elements, a storage section configured to store a one-line amount of image data, a drive circuit configured to energize each heating element according to the one-line amount of image data and an acquisition section configured to acquire an A/D value corresponding to the voltage applied to each heating element every time each heating element is energized. The disconnection check method comprises outputting a one-line amount of empty data to the storage section to acquire a first A/D value with the acquisition section, energizing each heating element to acquire a second A/D value, reducing noises of the second A/D value based on the first A/D value, and detecting the disconnection of each heating element based on the noise-reduced second A/D value.

Embodiments of the present invention are described below with reference to accompanying drawings.

Figure 1:
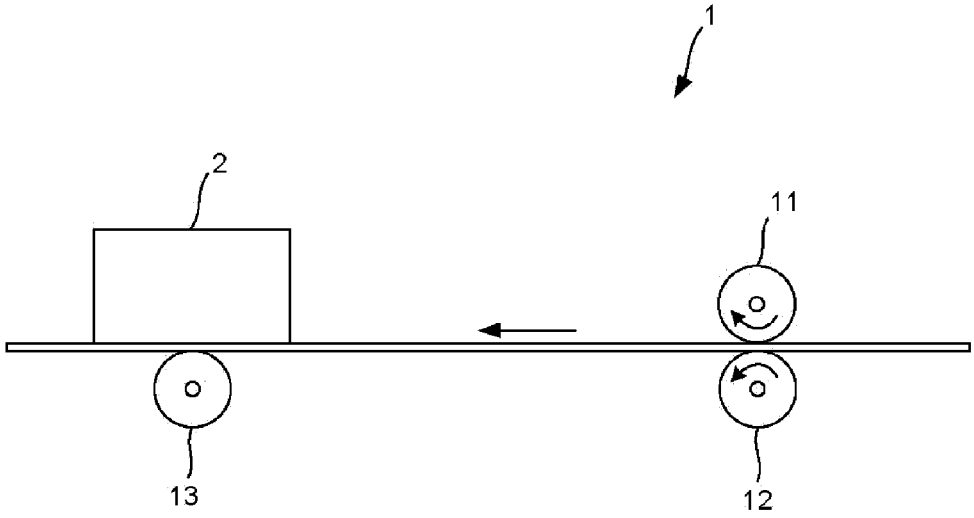
FIG. 1 is a diagram illustrating the printing principle of a thermal printer.

FIG. 1 is a diagram illustrating the printing principle of a thermal printer 1 (hereinafter, referred to as a printer 1).

The printer 1 conveys, with a drive roller 11 and a driven roller 12, a thermosensitive sheet to the space between a thermal head 2 and a platen roller 13. The printer 1 prints, with the thermal head 2, commodity names, prices and barcodes on the thermosensitive sheet based on the printing data received from an external terminal.

A plurality of heating elements 24 (FIG. 3) which are linearly arranged along the width direction of the thermosensitive sheet are configured on the surface of the thermal head 2 contacted with the thermosensitive sheet. The thermal head 2 selectively energizes the heating elements 24 and makes the heating elements 24 emit heat to forms a one-dot amount of patterns on the thermosensitive sheet with the heating elements 24 by making the heating elements 24 emit heat. By carrying out the operation above with the linearly arranged heating elements 24, the thermal head 2 forms a one-dot amount of images on the thermosensitive sheet.

Figure 2:
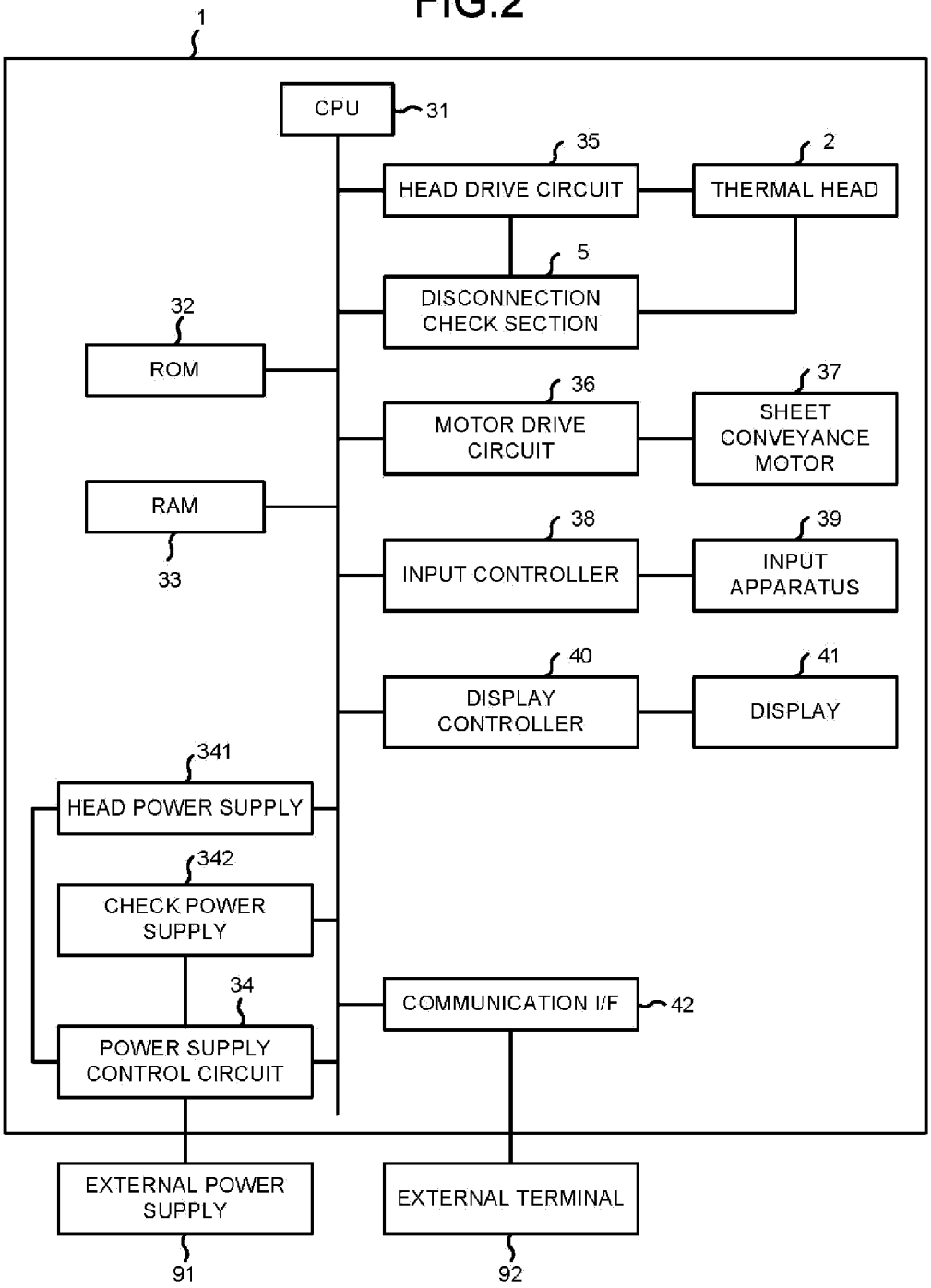
FIG. 2 is a block diagram illustrating the configuration of a printer.

FIG. 2 is a block diagram illustrating the configuration of the printer 1.

The printer 1 comprises a CPU (Central Processing Unit, controller) 31, a ROM 32, a RAM 33, a power supply control circuit 34, a head power supply 341, a check power supply 342, a head drive circuit 35, a disconnection check section 5, a motor drive circuit 36, a sheet conveyance motor 37, an input controller 38, an input device 39, a display controller 40, a display 41 and a communication I/F (Interface) 42.

The CPU 31 controls the whole printer 1. The CPU 31 achieves various functions by executing the programs stored in the ROM 32 and the RAM 33. Various control programs are stored in the ROM 32. The RAM 33 provides a temporary work area for the CPU 31.

The power supply control circuit 34 controls the power supply wherein the power is supplied from an external power supply 91 for each component. The head power supply 341 is a power supply which supplies power for the thermal head 2 during a normal printing. The check power supply 342 is a power supply which supplies, during a disconnection of the heating elements 24 of the thermal head 2, each heating element 24 with a power not strong enough for the heating element 24 to print.

The head drive circuit 35 drives the thermal head 2. The disconnection check section 5, which comprises the elements necessary for carryout detecting a disconnection of the thermal head 2, will be described in detail later. The motor drive circuit 36 drives the drive roller 11 through the sheet conveyance motor 37. The input device 39, which is a keyboard, a mouse or a touch panel, accepts the operation input of a user. The input controller 38 controls the input apparatus 39. The display controller 40 controls the display of the display 41. The communication I/F 42 communicates with an external terminal 92 such as a Personal Computer.

Figure 3:
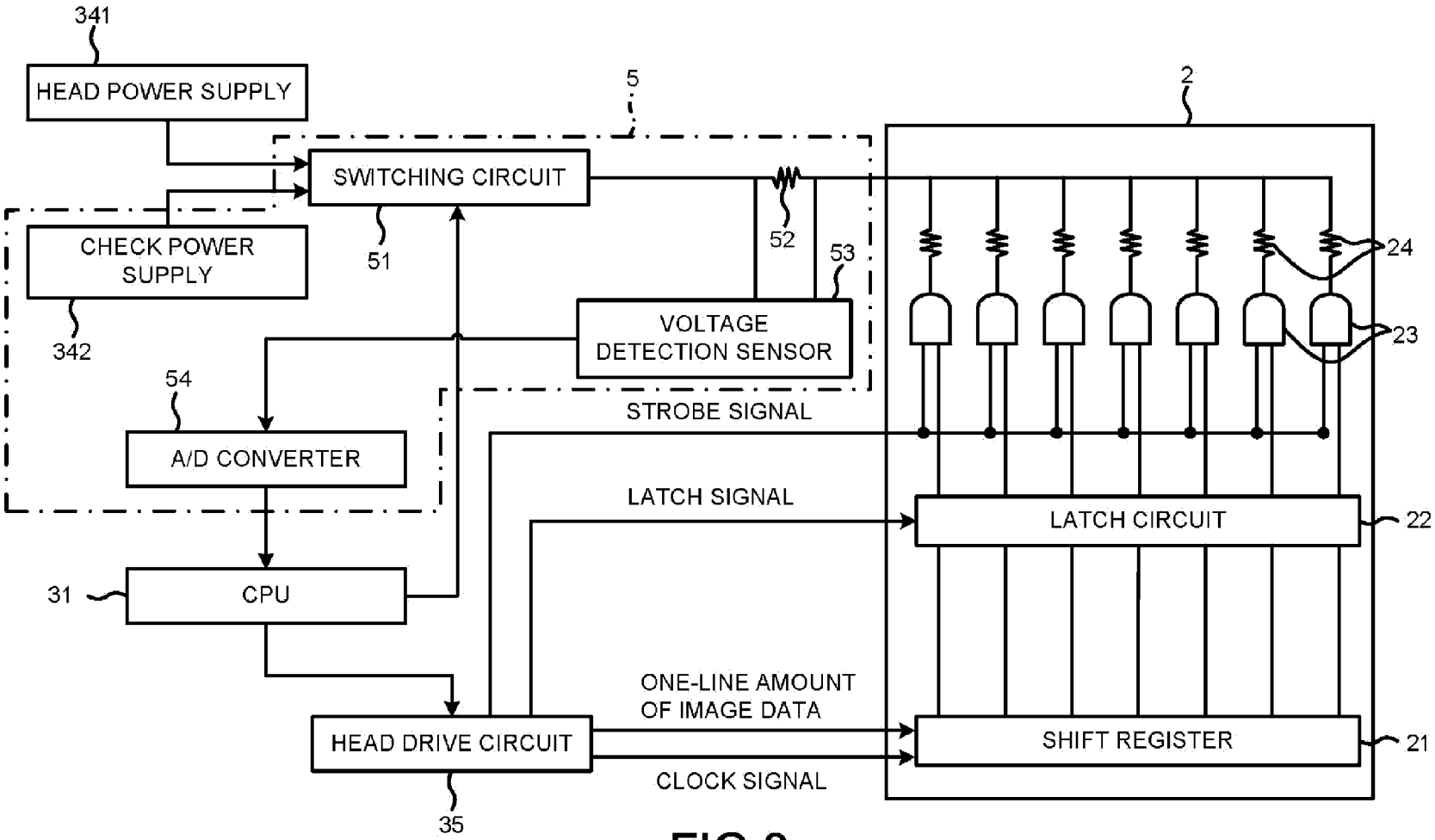
FIG. 3 is a diagram illustrating the configuration of a thermal head and the configuration of a disconnection check section.

FIG. 3 is a diagram illustrating the configuration of the thermal head 2 and the configuration of the disconnection check section 5.

The thermal head 2 comprises a shift register 21 (the storage section), a latch circuit 22, a NAND circuit 23 (the drive circuit) and heating elements 24.

The shift register 21 stores the one-line amount of image data output by the CPU 31 through the head drive circuit 35. The shift register 21 sequentially acquires the one-line amount of image data output by the CPU 31 in synchronism with clock signals. The image data refers to serial data 1 or 0 indicating the 'ON' or 'OFF' of each linearly arranged heating element. The shift register 21 assigns each of the heating elements 24 with a one-line amount of image data serving as the acquired serial data.

The latch circuit 22 acquires a one-line amount of image data from the shift register 21 when the one-line amount of image data is stored in the shift register 21 and the latch signal output by the CPU 31 is ON.

The NAND circuit 23 energizes each heating element 24 according to the one-line amount of image data stored in the shift register 21. That is, the one-line amount of image data stored in the shift register 21 is stored in the lath circuit 22, as stated above. Then, with the function of the NAND circuit 23, the heating element 24 corresponding to the image data is energized to emit heat only when the strobe signal output by the CPU 31 is ON (1) and the image data stored in the latch circuit 22 is 1; and, with the function of the NAND circuit 23, when the image data stored in the latch circuit 22 is 0, the heating element 24 corresponding to the image data is not energize to emit heat even if the strobe signal output by CPU 31 is ON (1).

The disconnection check section 5 comprises a switching circuit 51, resistance 52, a check power supply 342, a voltage detection sensor 53 and an A/D converter (Analog to Digital converter) 54.

Under the control of the CPU 31, the switching circuit 51 switches the power supply supplying power for the heating element 24 to any one of the head power supply 341 for printing and the check power supply 342 for disconnection check.

The resistance 52 are positioned between the power supplies 341 and 342 and the heating elements 24.

The voltage detection sensor 53 detects the voltages between both ends of the resistance 52.

The A/D converter 54 converts the analog data output by the voltage detection sensor 53 to digital data and outputs the digital data to the CPU 31 as an A/D value.

Here, as the heating elements 24 are energized one by one during disconnection check for the heating elements 24, the voltage applied to each heating element 24 can be known as long as the voltage applied to the resistance 52 is known. Thus, it can be said that the voltage detection sensor 53 detects the voltage applied to each heating element 24 every time each heating element 24 is energized when checking the disconnection. Moreover, it can be said that the CPU 31 acquires the A/D value (an A/D value corresponding to the voltage applied to each heating element 24) of the voltage applied to each heating element 24 when checking the disconnection.

However, as stated in the description of the background, the A/D value acquired by the CPU 31 when each heating element 24 is energized contains noises. The inventor finds that the noises are noises acquired through the action of the noises detected by the voltage detection sensor 53 when the heating element 24 is not energized.

Thus, in the embodiment, the A/D value detected when the heating element 24 is not energized is acquired as a noise value, then, in the embodiment, the voltage value (A/D value) of the heating element 24 is subjected to a noise reduction processing based on the noise value when checking the disconnection, thereby improving the accuracy in discrimination in a disconnected state.

Figure 4:
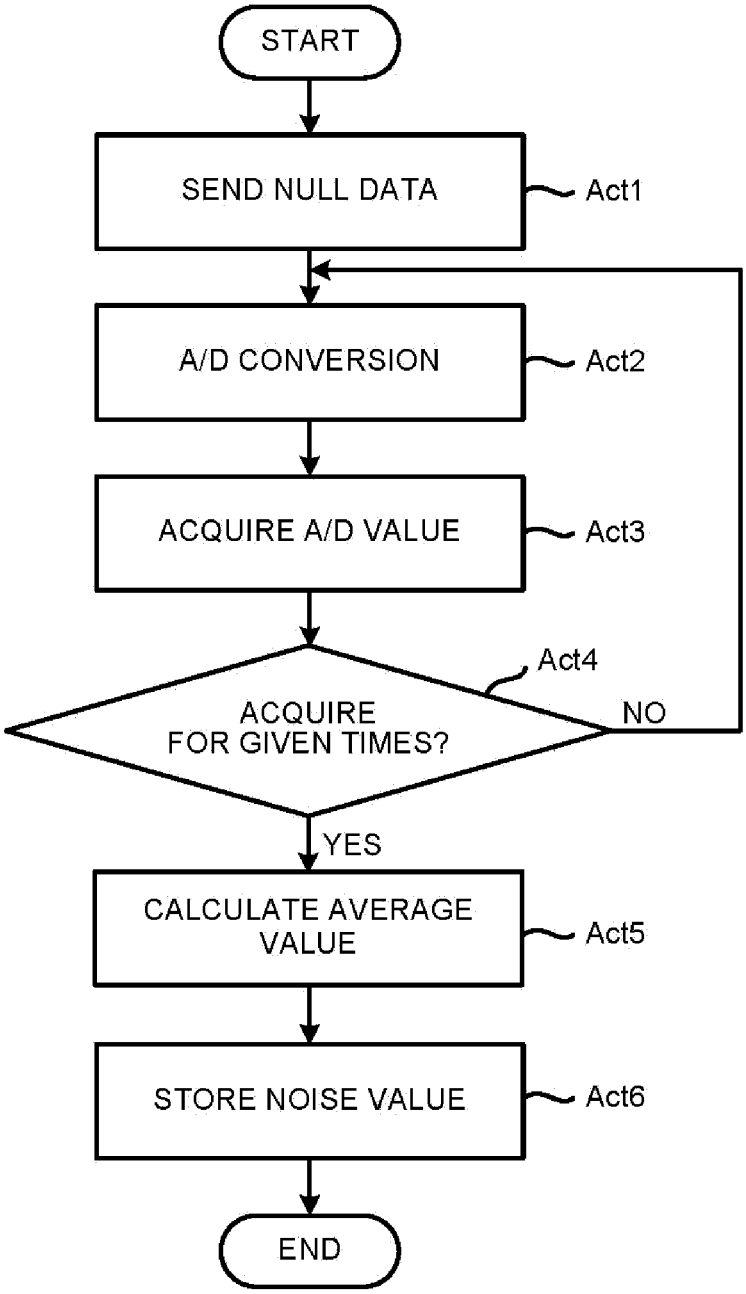
FIG. 4 is a flowchart illustrating a noise value acquisition processing.

A noise value acquisition processing is described below with reference to the flowchart of FIG. 4.

The CPU 31 carries out the following noise value acquisition processing when the printer is started.

The CPU 31 sets a power supply to be the check power supply 342 and outputs NULL data (image data corresponding to each heating element 24 are all 0) serving as a one-line amount of empty data indicating the OFF of each heating element 24 to the shift register 21. The CPU 31 makes the latch signal to be ON, makes the latch circuit 22 acquire NULL data and makes the strobe signal to be ON (Act 1).

The A/D converter 54 carries out an A/D conversion for an output signal from the voltage detection sensor 53 representing the voltage value currently detected by the voltage detection sensor 53 (Act 2).

The CPU 31 acquires an A/D value representing the voltage value detected by the voltage detection sensor 53 and stores the A/D value in the ROM 32 (Act 3). As stated above, the A/D value is noises acting on an A/D value acquired when a voltage is applied to each heating element 24 during checking the disconnection.

The CPU 31 outputs the NULL data to acquire A/D values repeatedly for a given times in the way described above (Act 4).

The CPU 31 calculates the average value (a first A/D value) of the A/D values (Act 5) when acquiring A/D values for a given times (YES in Act 4).

The CPU 31 stores the average value of the A/D values in the ROM 32 as a noise value which is always functioning among the detection value obtained by the voltage detection sensor 53 (Act 6).

Figure 5:
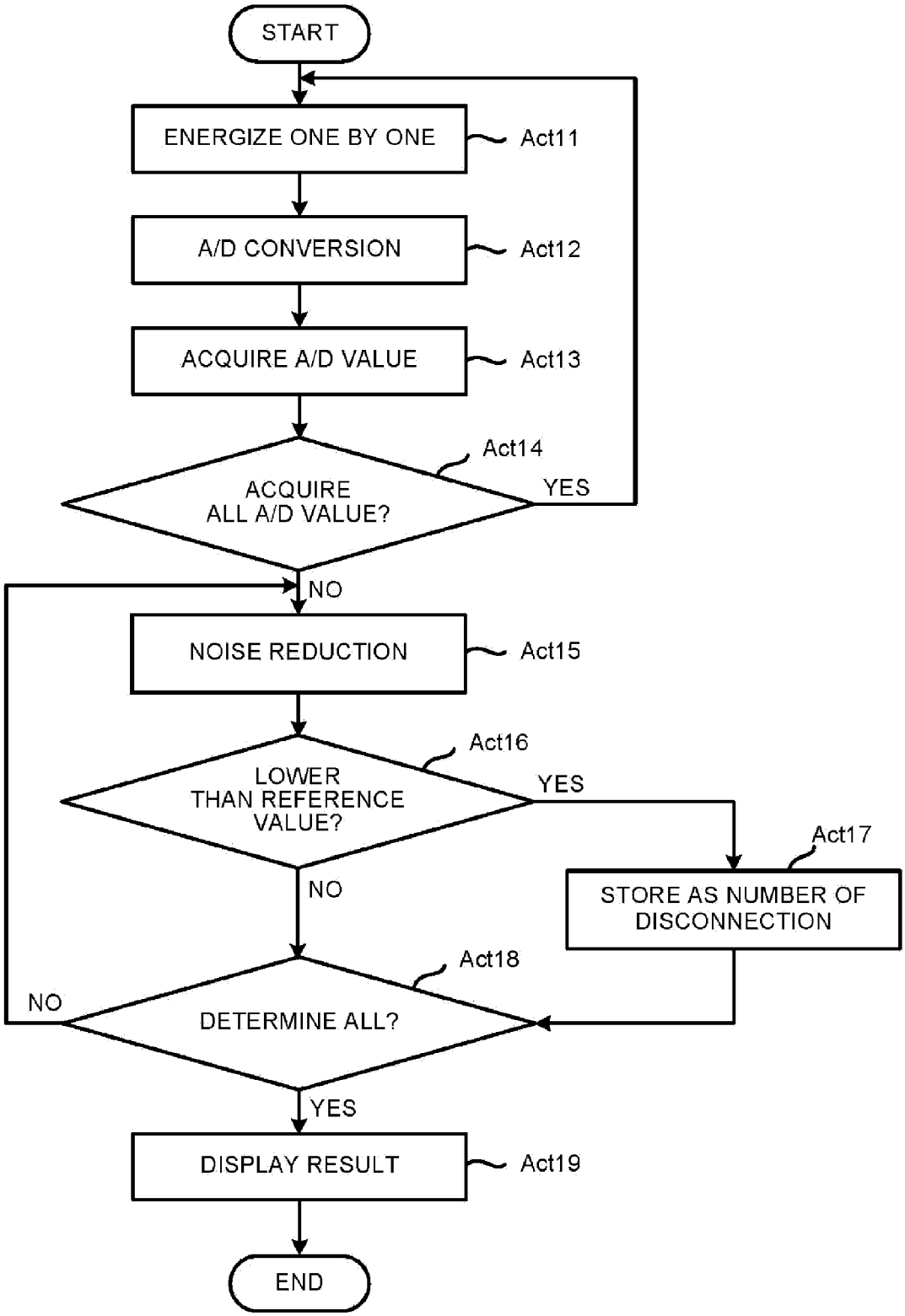
FIG. 5 is a flowchart illustrating a disconnection checking processing.

A disconnection checking processing is described below with reference to the flowchart of FIG. 5.

The CPU 31 outputs a one-line amount of image data which making only one heating element 24 to be energized, makes a latch signal and a strobe signal to be ON and merely energizes one heating element 24 (Act 11).

The A/D converter 54 carries out an A/D conversion for an output signal from the voltage detection sensor 53 representing the voltage (a voltage corresponding to the voltage applied to the energized heating element 24) applied to the energized heating element 24 (Act 12).

The CPU 31 acquires, from the A/D converter 54, an A/D value (a second A/D value) representing the voltage applied to the energized heating element 24 and stores the A/D value in the ROM 32 (Act 13).

The CPU 31 energizes each heating element 24 in this way and acquires the A/D value representing the currently detected voltage applied to each heating element 24 for the amount of all the heating elements 24 (Act 14).

The CPU 31 reduces noises of an A/D value representing the voltage value applied to a heating element 24 based on the noise value (Act 15). In the embodiment, the CPU 31 reduces noises of the A/D value (an A/D value representing the voltage applied to a heating element 24) of a heating element 24 by deducting the noise value from the A/D value representing the voltage applied to the heating element 24.

The CPU 31 determines whether or not the noise-reduced A/D value of the heating element 24 is lower than a reference value (Act 16).

The CPU 31 determines that the heating element 24 is disconnected if the A/D value of the heating element 24 is lower than the reference value (YES in Act 16) and counts up the number of disconnection by 1 (Act 17).

The CPU 31 checks the disconnected state for all the heating elements 24 in this way and counts up the number of disconnection of all the heating elements 24 (Act 18).

The CPU 31 displays the number of disconnection of the heating elements 24 on the display 41 (Act 19) when all disconnection of the heating elements 24 are counted up (YES in Act 18).

The sequence of each processing carried out in the embodiment may be different from the exemplified one.

The disconnection check method according to the embodiment is also applicable to the thermal head of a thermal printer performing printing with an ink ribbon.

As stated above in detail, according to the technology disclosed herein, a technology of checking the disconnection of a thermal head is provided.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A thermal printer, comprising:

a plurality of linearly arranged heating elements;

a storage section configured to store a one-line amount of image data;

a drive circuit configured to energize each heating element according to the one-line amount of image data;

an acquisition section configured to acquire an A/D value corresponding to the voltage applied to each heating element every time each heating element is energized; and a controller configured to output a one-line amount of empty data to the storage section to acquire a first A/D value with the acquisition section, reduce, based on the first A/D value, noises of a second A/D value acquired by energizing each heating element, and check the disconnection of each heating element based on the noise-reduced second A/D value.

2. The apparatus according to claim 1, wherein the controller sends empty data to the storage section for many times to acquire A/D values and acquires the average value of the A/D values as the first A/D value.

3. The apparatus according to claim 1, wherein the controller is an apparatus which carries out disconnection check when the thermal printer is started.

4. A disconnection check method for a thermal printer comprising a plurality of linearly arranged heating elements; a storage section configured to store a one-line amount of image data; a drive circuit configured to energize each heating element according to the one-line amount of image data; and an acquisition section configured to acquire an A/D value corresponding to the voltage applied to each heating element every time each heating element is energized, including:

outputting a one-line amount of empty data to the storage section to acquire a first A/D value with the acquisition section;

energizing each heating element to acquire a second A/D value;

reducing noises of the second A/D value based on the first A/D value; and checking the disconnection of each heating element based on the noise-reduced second A/D value.

5. The method according to claim 4, wherein empty data is sent to the storage section for many times to acquire A/D values, and the average value of the A/D values is acquired as the first A/D value.

6. The method according to claim 4, wherein the method is a method for carrying out disconnection check when the thermal printer is started.

* * * * *